US007114770B2

(12) United States Patent
Murphy

(10) Patent No.: US 7,114,770 B2
(45) Date of Patent: Oct. 3, 2006

(54) HEALTH CARE CHAIR WITH RECLINING BACKREST AND EXTENDABLE OTTOMAN

(75) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 10/899,792

(22) Filed: Jul. 27, 2004

(65) Prior Publication Data

US 2005/0104420 A1 May 19, 2005

Related U.S. Application Data

(60) Provisional application No. 60/493,951, filed on Aug. 8, 2003.

(51) Int. Cl.
*A47C 1/02* (2006.01)

(52) U.S. Cl. ..... 297/85; 297/423.26

(58) Field of Classification Search ..... 297/354.13, 297/340, 423.26, 85, 84
See application file for complete search history.

(56) References Cited

U.S. PATENT DOCUMENTS 5,865,457 A * 2/1999 Knabusch et al. ..... 280/304.1
5,868,461 A * 2/1999 Brotherston ..... 297/84
6,154,899 A * 12/2000 Brooke et al. ..... 5/81.1 R

* cited by examiner

*Primary Examiner*—Milton Nelson, Jr.
(74) *Attorney, Agent, or Firm*—Myers Bigel Sibley & Sajovec

(57) ABSTRACT

A reclining seating unit includes: a frame having two arms; a backrest; a seat; at least one ottoman; an ottoman linkage, and a reclining mechanism. The ottoman linkage is attached to the frame and to the at least one ottoman and includes a plurality of pivotally interconnected links that are configured to move the at least one ottoman between a retracted position, in which the at least one ottoman is positioned below the seat, and an extended position, in which the at least one ottoman is disposed generally horizontally and in front of the seat. The reclining mechanism is attached to the backrest, the seat and the frame and includeses a plurality of pivotally interconnected links. The reclining mechanism is configured to move the backrest between an upright position, in which the backrest is generally vertically disposed and positioned above a rear portion of the seat, and the seat is slightly inclined from rear to front at a first seat angle, and a fully reclined position, in which the backrest is generally horizontally disposed and positioned rearwardly of the seat, and the seat is inclined from rear to front at a second seat angle that is less than the first seat angle, the rear portion of the seat having risen in moving from the upright to the fully reclined position.

20 Claims, 3 Drawing Sheets

HEALTH CARE CHAIR WITH RECLINING BACKREST AND EXTENDABLE OTTOMAN

RELATED APPLICATIONS

This application claims priority from U.S. Provisional Patent Application Ser. No. 60/493,951, filed Aug. 8, 2003, the disclosure of which is hereby incorporated herein by reference in its entirety.

FIELD OF THE INVENTION

The present invention is directed to furniture, and more particularly to seating units for the health care industry.

BACKGROUND OF THE INVENTION

The advent of home health care has created a need for furniture that provides functional features for the patient as well as more conventional function for others. For example, chairs exist that are capable of reclining in a number of positions in the same manner as traditional, non-medical recliner chairs while being movable to a "heart-rest" position (also known as the Trendellenburg position). The heart-rest position is one in which the occupant of the chair is postured such that his legs are elevated to a height equal to or above his heart, with the result that blood is encouraged to flow to the heart rather than pooling in the legs. This position is often used to treat shock (particularly during dialysis treatments).

One exemplary chair that combines reclining capability with the capacity to move to the heart-rest position is discussed and illustrated in U.S. Pat. No. 5,348,367 to Mizelle. The Mizelle chair includes a relatively simple six-bar linkage system and can stop in any intermediate position between an upright and a fully reclined position. An attendant can then lift the front of the seat frame of the chair to bring the chair into a "heart-rest" position in which the seat frame, back frame and leg rest assume "the position of a lounge chair that has been tilted approximately 45 degrees." Another exemplary chair, available from Lumex, Inc., utilizes a reclining mechanism from a conventional residential reclining chair. In this chair, the reclining mechanism is configured such that, once the chair is in a fully reclined position (i.e., one in which the backrest and seat have pivoted relative to one another so that the angle therebetween increases), a foot pedal can release the mechanism to continue its reclining motion, with the angle between the backrest and the seat continuing to increase. As a result, the heart-rest position of this chair provides a support surface in which mimics that of a hospital bed. Another exemplary chair, discussed in U.S. Pat. Publication No. 20030015893 to Hoffman et al., also utilizes a mechanism from a conventional three-way reclining chair. The chair can move from the fully reclined position to the heart-rest position by pivoting relative to the frame, such that the backrest and seat maintain a similar angle to one another; this pivoting movement is actuated by a foot pedal.

In view of the foregoing, additional configurations for health care chairs that serve specific functions or that separate the reclining and health care functions may be desirable.

SUMMARY OF EMBODIMENTS OF THE INVENTION

The present invention is directed generally to a reclining seating-unit. As a first aspect, embodiments of the invention are directed to a reclining seating unit comprising: a frame having two arms; a backrest; a seat; at least one ottoman; an ottoman linkage, and a reclining mechanism. The ottoman linkage is attached to the frame and to the at least one ottoman and comprises a plurality of pivotally interconnected links that are configured to move the at least one ottoman between a retracted position, in which the at least one ottoman is positioned below the seat, and an extended position, in which the at least one ottoman is disposed generally horizontally and in front of the seat. The reclining mechanism is attached to the backrest, the seat and the frame and comprises a plurality of pivotally interconnected links. The reclining mechanism is configured to move the backrest between an upright position, in which the backrest is generally vertically disposed and positioned above a rear portion of the seat, and the seat is slightly inclined from rear to front at a first seat angle, and a fully reclined position, in which the backrest is generally horizontally disposed and positioned rearwardly of the seat, and the seat is inclined from rear to front at a second seat angle that is less than the first seat angle, the rear portion of the seat having risen in moving from the upright to the fully reclined position. In this configuration, the reclining seating unit can provide a support surface that is appropriate for either a sleeping occupant or an occupant in need of health care services.

In some embodiments, the reclining mechanism includes a movement-resistance unit that resists movement of the backrest from the upright to the fully reclined position. In additional embodiments the movement-resistance unit (for example, a gas cylinder) is configured to enable the backrest to cease movement in multiple positions between the upright and fully reclined positions. Further embodiments include reclining mechanisms and ottoman linkages that are decoupled from one another.

DETAILED DESCRIPTION OF EMBODIMENTS OF THE INVENTION

Figure 1:
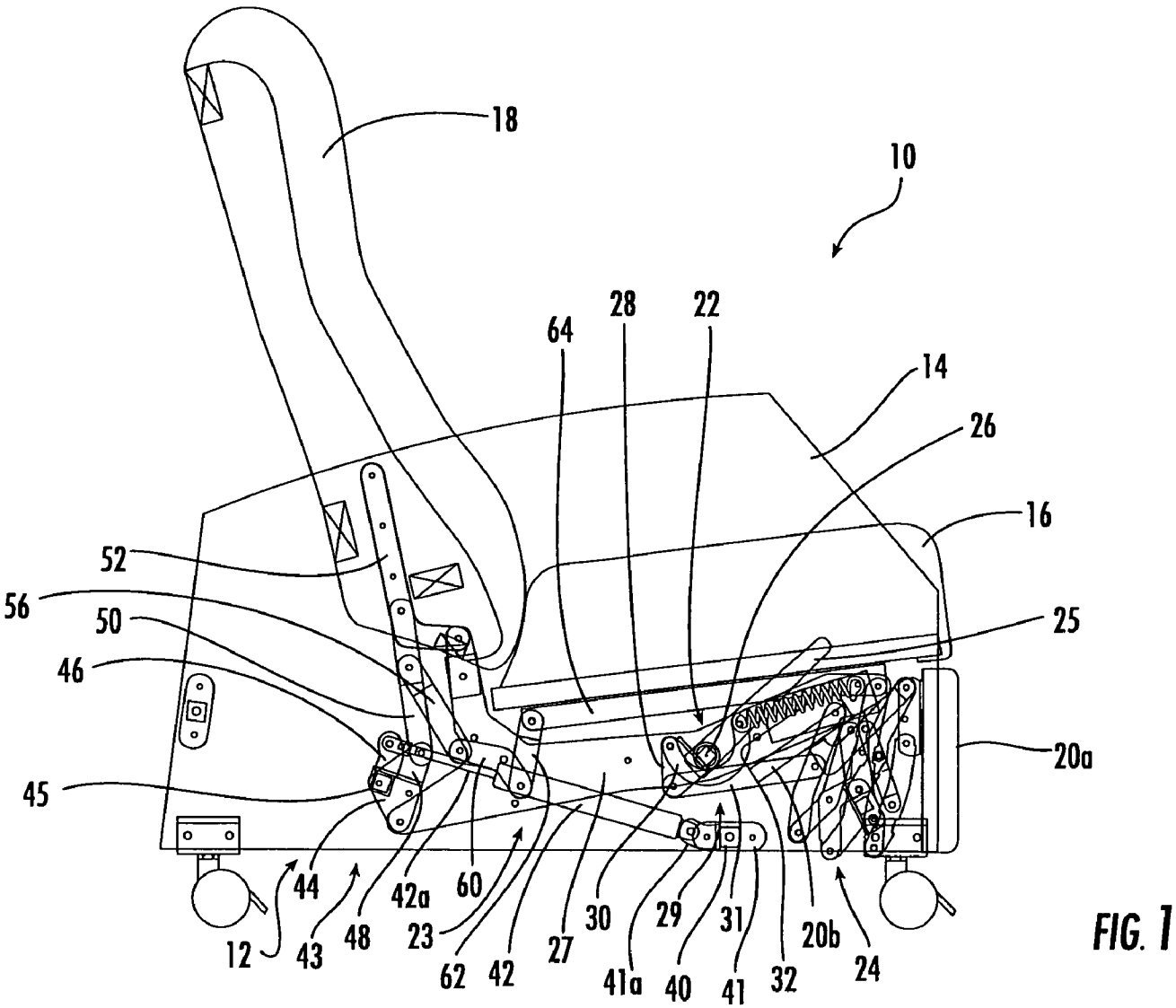
FIG. 1 is a side view of a chair of the present invention in its upright position with the ottomans retracted.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The present invention is directed to a reclining chair having a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the chair. The term "outward" and derivatives thereof refer to the direction defined by a vector originating in the center of the seat and extending in the plane of the underlying surface and perpendicular to the forward and rearward directions. The terms "inboard", "inward" and derivatives thereof refer to the direction directly opposite to the lateral direction as defined hereinabove. The outward and inward directions together comprise the "lateral" or "transverse" directions relative to the chair.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4–21 (1979).

Referring now to the Figures, a chair, designated broadly at 10, is disclosed in FIG. 1. The chair 10 includes a frame 12 with arms 14, a seat 16, a backrest 18, and a pair of ottomans 20*a*, 20*b*. The seat 16 and backrest 18 are interconnected with one another by mirror image reclining mechanisms 22, which permit relative movement thereof. The reclining mechanisms 22 are also attached to the frame 14. The ottomans 20*a*, 20*b* are mounted to the frame 14 via two mirror image ottoman linkages 24.

Those skilled in this art will appreciate that other types of seating units, including love seats, sofas, couches, and the like, may also be employed with the present invention.

The ottomans 20*a*, 20*b* are movable between a retracted position (FIG. 1) and an extended position (FIG. 2) via a handle 25 that is mounted to the frame 14. Rotation of the handle 25 (rotation is counterclockwise from the vantage point of FIG. 1) moves the ottoman 20*a* from a position below the front edge of the seat 16, in which the ottoman 20*a* is generally vertically disposed, to a position in front of the seat 16, in which the ottoman 20*a* is generally horizontally disposed. At the same time, the ottoman 20*b* moves from a retracted position below the seat 16 and behind the ottoman 20*a* to an extended position in which it is horizontally disposed and between the seat 16 and the ottoman 20*b*. The ottomans 20*a*, 20*b* can be returned to their retracted positions by rotating the handle 25 in the opposite direction.

Figure 2:
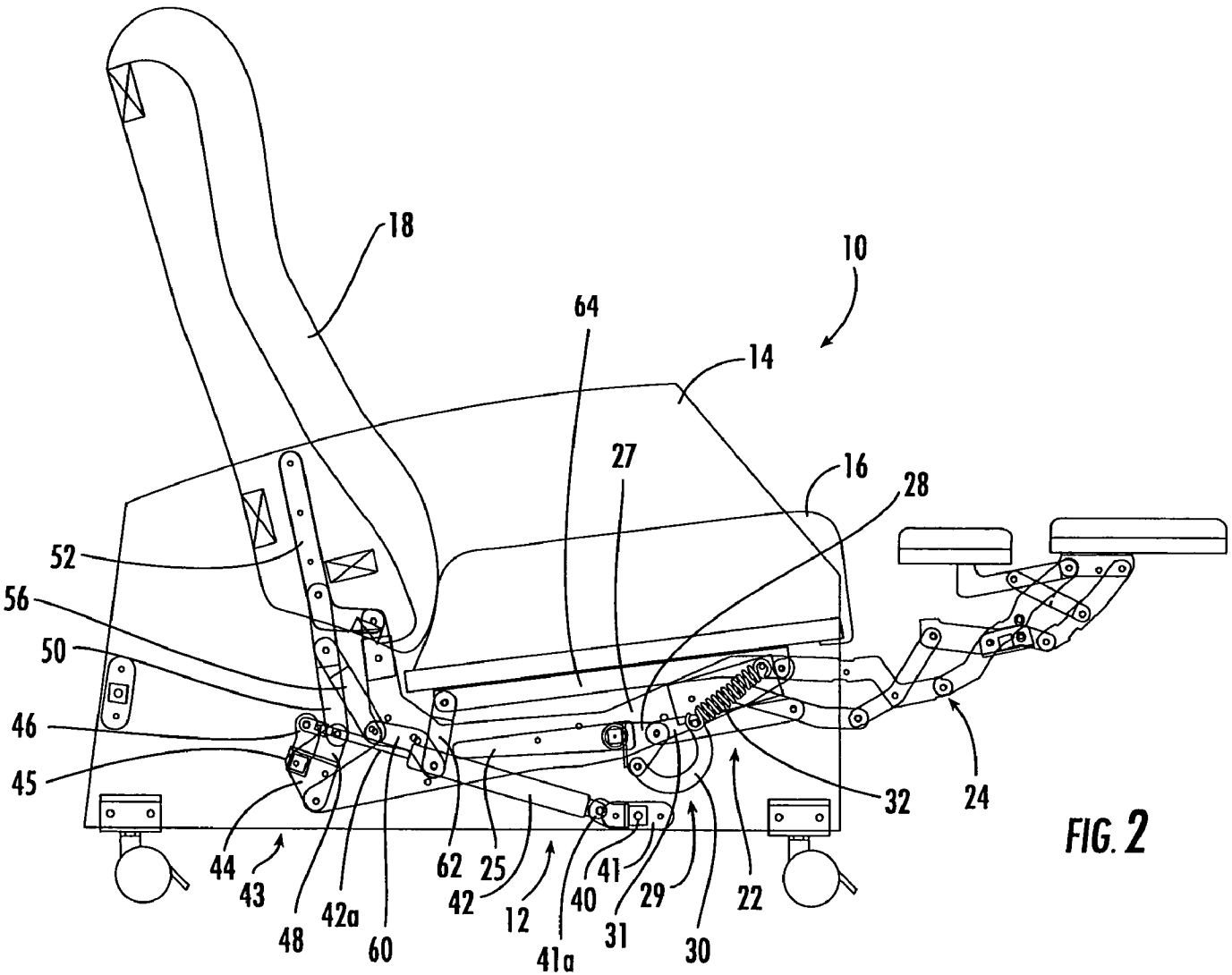
FIG. 2 is a side view of the chair of FIG. 1 with the ottomans extended.

Rotation of the handle 25 drives the ottomans 20*a*, 20*b* through an ottoman drive mechanism 29. Referring to FIGS. 1 and 2, the ottoman drive linkage 29 includes a cross member 26 that is attached to the handle 25 and extends transversely across the chair 10, a crank 28 that is mounted to the cross member 26, an ottoman drive link 31 that is pivotally attached at one end to the crank 28 and at the other end to the ottoman linkage 24, a balance link 30 that is attached to the crank 28, and a spring 32 that is attached at one end to the balance link 30 and to the other end to a mounting bracket 27 mounted to the inner surface of an arm 14.

Rotation of the handle 25 when the chair 10 is in the retracted position of FIG. 1 causes the cross member 26 to rotate counterclockwise, which action draws the crank 28 downwardly and forwardly. This motion drives the ottoman drive link 31 forward, which in turn extends the ottoman linkage 24. The motion is balanced by the spring 32 as it acts on the balance link 30.

The ottoman linkage 24, which is connected to the mounting bracket 27 and to a seat bracket 64 that underlies the seat 16, can be any of a number of ottoman linkages (typically pantographic linkages) that are known by those skilled in this art to be suitable for retracting and extending an ottoman. Other suitable ottoman linkages are shown in, for example, U.S. Pat. Nos. 4,691,961; 4,519,647; 5,087,0945, 354,116; and 5,374,100, the disclosures of each of which are hereby incorporated herein in their entireties. It should be noted that the ottoman linkage 24 is configured and mounted such that, in the extended position, the ottomans 20*a*, 20*b* are generally level with the upper surface of the seat 16. It should also be understood that the seating unit may include only one ottoman, or may include three or more, as desired.

Figure 3:
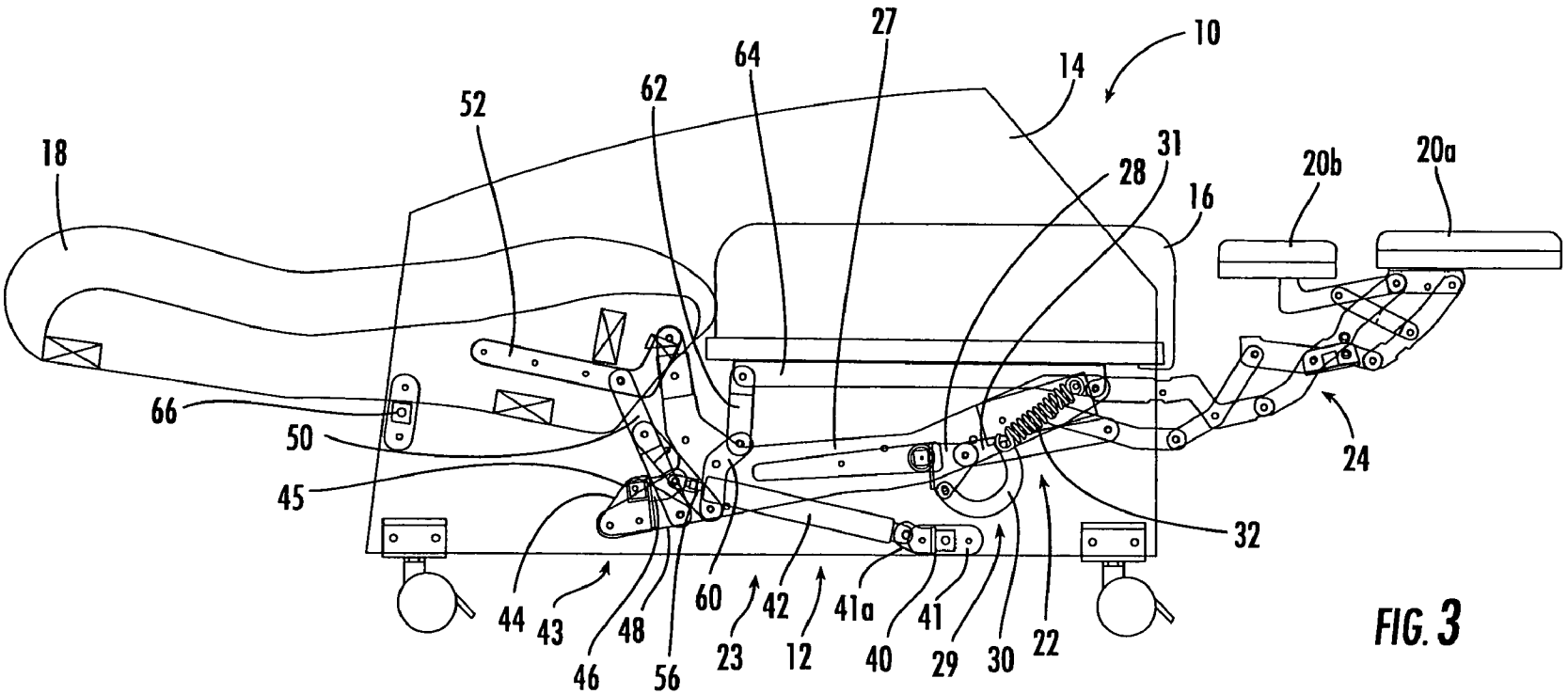
FIG. 3 is a side view of the chair of FIG. 1 with the ottomans extended and the backrest in a fully reclined position that is appropriate for a heart-rest posture for the occupant.

Referring now to FIGS. 1 and 3, reclining movement of the backrest 18 relative to the seat 16 is illustrated. In this embodiment, the backrest 18 can be reclined relative to the seat 16 through an occupant of the chair 10 by manipulating a release lever (not shown) that is mounted on the arm 14 of the chair 10. This action releases a locking pneumatic cylinder 42 (described in greater detail below) and allows the backrest 18 to recline. The movement of the backrest 18 and the seat 16 relative to each other and to the frame 14 is controlled by the reclining mechanisms 22, one of which is described in greater detail below. Notably, in the illustrated embodiment, the reclining mechanisms 22 are decoupled from the ottoman linkage 24.

The reclining mechanism 22 comprises a control linkage 23 that includes a cylinder mounting tube 40 that extends transversely between the arms 14 and is mounted thereto via a mounting bracket 41. A finger 41*a* extends rearwardly from the tube 40. The locking gas cylinder 42 is pivotally mounted to the finger 41*a*. A retractable rod 42*a* is seated in and extends rearwardly from the cylinder 42. An exemplary locking gas cylinder is the BLOC-O-LIFT Model No. 732125, available from Stabilus GmbH, Charlotte, N.C. The rod 42*a* is attached to a cylinder pivot unit 43, which includes a tying link 44, a transition link 48, a cylinder link 46, and a cross-member 45. The tying link 44 is pivotally attached to a rear end of the mounting bracket 27 that is, in turn, mounted to the arm 14 of the chair 10. The cross-member 45 extends between the opposing tying links 44, and the cylinder link 46 extends from the cross-member 45 to pivotally attach to the cylinder rod 42*a*. The transition link 48 is fixed to the tying link 44 and pivots therewith. A backrest drive link 50 is pivotally attached to the transition link 48 and extends upwardly therefrom. The backrest drive link 50 is pivotally attached to an intermediate portion of a backpost 52 that is fixed to the backrest 18.

A forward leg of the backpost 52 is pivotally attached to an upper projection of the mounting bracket 27. A seat drive link 56 is attached at one end to an intermediate portion of the backrest drive link 50 and at its opposite end to an angled control link 60. The control link 60 is pivotally attached at its vertex to the mounting bracket 27 and at its other end to a seat raising link 62, which is also pivotally attached to the rearward end of the seat bracket 64.

To move the chair 10 to its reclined position of FIG. 3 from the upright position of FIGS. 1 and 2, the occupant manipulates the release lever to unlock the cylinder 42. Such a force causes the backrest 18 to recline as the backpost 52 pivots relative to the mounting bracket 27. As the backpost 52 moves rearwardly and downwardly, it forces the backrest drive link 50 downwardly, which in turn drives the upper end of the transition link 48 forward as it rotates relative to the mounting bracket 27. This movement is controlled by resisted retraction of the rod 42*a* within the gas cylinder 42; employment of the gas cylinder 42 can enable the backrest 18 to cease movement in any position between the upright position of FIG. 1 and the fully reclined position of FIG. 3 simply via the occupant releasing the release lever and causing the cylinder 42 to lock in that position. The backrest 18 reaches the fully reclined position when it contacts a cross-member 66 that extends transversely between rear portions of the arms 14.

The downward movement of the backrest drive link 50 also forces the seat drive link 56 downward and forward. This action rotates the control link 60 about the mounting bracket 27 (counterclockwise from the vantage point of FIG. 1), which forces the drive link 62 upwardly, thereby raising the rear edge of the seat 16, which rotates about a pivot located at the front portion of the mounting bracket 27.

Those skilled in this art will appreciate that, rather than using a locking gas cylinder, one may also employ a gas cylinder with sufficient resistance to enable the backrest 18 to cease its movement in any position. Typically, the resistance provided by the gas cylinder 42 is between about 500 and 1,000 Newtons. In such an instance, reclining can be commenced by the occupant of the chair applying a rearward force to the backrest 18 (typically this is initiated by pushing rearwardly on the arms of the chair 10 to force the occupant's back against the backrest 18). Also, the gas cylinder 42 may be replaced with other units that would maintain the backrest 18 in a desired position but enable movement between the upright and fully reclined positions; exemplary movement-resistance substitutes includes friction-imparting units such as friction bearings. Moreover, the gas cylinder 42 may be replaced by an electrically-powered cylinder unit or other electrical unit that enables the backrest to maintain different desired positions between the upright and fully reclined positions.

As can be seen in FIG. 3, in the fully reclined position, the seat 16 is substantially horizontal and level with the ottomans 20*a*, 20*b*. The backrest 18 is also generally horizontal. A such, the chair 10 can provide either a support surface that is suitable for rapid treatment of a patient or a body support for sitting or sleeping.

The foregoing is illustrative of the present invention and is not to be construed as limiting thereof, the invention being defined by the claims that follow. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That Which is Claimed is:

1. A reclining seating unit, comprising:

a frame having two arms;

a backrest;

a seat;

at least one ottoman;

an ottoman linkage attached to the frame and to the at least one ottoman, the ottoman linkage comprising a plurality of pivotally interconnected links and configured to move the at least one ottoman between a retracted position, in which the at least one ottoman is positioned below the seat, and an extended position, in which the at least one ottoman is disposed generally horizontally and in front of the seat; and a reclining mechanism attached to the backrest, the seat and the frame, the reclining mechanism comprising a plurality of pivotally interconnected links and configured to move the backrest between an upright position, in which the backrest is generally vertically disposed and positioned above a rear portion of the seat, and the seat is disposed at a first seat angle relative to an underlying surface, and a fully reclined position, in which the backrest is generally horizontally disposed and positioned rearwardly of the seat, and the seat is disposed at a second seat angle relative to the underlying surface that is less than the first seat angle, the rear portion of the seat having risen in moving from the upright to the fully reclined position;

wherein the ottoman linkage and the reclining mechanism are decoupled from one another;

wherein the reclining mechanism further comprises a movement-resistance unit that resists movement of the backrest from the upright to the fully reclined position; and wherein the movement-resistance unit is configured to allow the backrest to cease movement in multiple positions between the upright and fully reclined positions.

2. The reclining seating unit defined in claim 1, wherein the movement-resistance unit comprises a gas cylinder.

3. The reclining seating unit defined in claim 2, wherein the reclining mechanism includes a control linkage comprising:

a cylinder pivot unit pivotally attached to one end of the gas cylinder and pivotally interconnected relative to the frame;

a finger pivotally attached to an opposite end of the gas cylinder and pivotally interconnected relative to the frame; and a backrest drive link pivotally attached to the cylinder pivot unit and with a backpost fixed to the backrest.

4. The reclining seating unit defined in claim 3, wherein the backrest drive link is coupled to a control linkage that includes a gas cylinder.

5. The reclining seating unit defined in claim 3, wherein the backpost, cylinder pivot unit and ottoman linkage are pivotally attached to a unitary mounting bracket.

6. The reclining seating unit defined in claim 1, wherein the frame further comprises castors.

7. A reclining seating unit, comprising:

a frame having two arms;

a backrest;

a seat;

at least one ottoman;

an ottoman linkage attached to the frame and to the at least one ottoman, the ottoman linkage comprising a plurality of pivotally interconnected links and configured to move the at least one ottoman between a retracted position, in which the at least one ottoman is positioned below the seat, and an extended position, in which the at least one ottoman is disposed generally horizontally and in front of the seat; and a reclining mechanism attached to the backrest, the seat and the frame, the reclining mechanism comprising a plurality of pivotally interconnected links and configured to move the backrest between an upright position, in which the backrest is generally vertically disposed and positioned above a rear portion of the seat, and the seat disposed is at a first seat angle relative to an underlying surface, and a fully reclined position, in which the backrest is generally horizontally disposed and positioned rearwardly of the seat, and the seat is disposed at a second seat angle relative to the underlying surface that is less than the first seat angle, the rear portion of the seat having risen in moving from the upright to the fully reclined position;

wherein the reclining mechanism comprises:

a seat raising link pivotally interconnected with the seat;

a control link pivotally interconnected with the seat raising link and with a mounting bracket mounted on the frame;

a seat drive link pivotally connected with the control link;

a backrest drive link pivotally interconnected with the seat drive link and with a backpost fixed to the backrest;

a gas cylinder; and a control linkage comprising:

a cylinder pivot unit pivotally attached to one end of the gas cylinder and pivotally interconnected relative to the frame;

a finger pivotally attached to an opposite end of the gas cylinder and pivotally interconnected relative to the frame;

wherein the backrest drive link is pivotally attached to the cylinder pivot unit.

8. The reclining seating unit defined in claim 7, wherein the ottoman linkage and the reclining mechanism are decoupled from one another.

9. The reclining seating unit defined in claim 7, further comprising a handle rotatably mounted to one of the frame arms and connected with the ottoman linkage to drive the ottoman linkage between the retracted and extended positions.

10. The reclining seating unit defined in claim 7, wherein the frame further comprises castors.

11. The reclining seating unit defined in claim 7, wherein the backpost, cylinder pivot unit and ottoman linkage are pivotally attached to a unitary mounting bracket.

12. The reclining seating unit defined in claim 11, wherein the front portion of the seat is pivotally interconnected with the mounting bracket.

13. The reclining seating unit defined in claim 7, wherein the at least one ottoman is two ottomans.

14. A reclining seating unit, comprising:

a frame having two arms;

a backrest;

a seat;

at least one ottoman;

an ottoman linkage attached to the frame and to the at least one ottoman, the ottoman linkage comprising a plurality of pivotally interconnected links and configured to move the at least one ottoman between a retracted position, in which the at least one ottoman is positioned below the seat, and an extended position, in which the at least one ottoman is disposed generally horizontally and in front of the seat; and a reclining mechanism attached to the backrest, the seat and the frame, the reclining mechanism comprising a plurality of pivotally interconnected links and configured to move the backrest between an upright position, in which the backrest is generally vertically disposed and positioned above a rear portion of the seat, and the seat is disposed at a first seat angle relative to an underlying surface, and a fully reclined position, in which the backrest is generally horizontally disposed and positioned rearwardly of the seat, and the seat is disposed at a second seat angle relative to the underlying surface that is less than the first seat angle, the rear portion of the seat having risen in moving from the upright to the fully reclined position;

wherein the reclining mechanism comprises:

a seat raising link pivotally interconnected with the seat;

a control link pivotally interconnected with the seat raising link and with a mounting bracket mounted on the frame;

a seat drive link pivotally connected with the control link; and a backrest drive link pivotally interconnected with the seat drive link and with a backpost fixed to the backrest.

15. A reclining seating unit, comprising:

a frame having two arms;

a backrest;

a seat;

at least one ottoman;

an ottoman linkage attached to the frame and to the at least one ottoman, the ottoman linkage comprising a plurality of pivotally interconnected links and configured to move the at least one ottoman between a retracted position, in which the at least one ottoman is positioned below the seat, and an extended position, in which the at least one ottoman is disposed generally horizontally and in front of the seat; and a reclining mechanism attached to the backrest, the seat and the frame, the reclining mechanism comprising a plurality of pivotally interconnected links and configured to move the backrest between an upright position, in which the backrest is generally vertically disposed and positioned above a rear portion of the seat, and the seat is disposed at a first seat angle relative to an underlying surface, and a fully reclined position, in which the backrest is generally horizontally disposed and positioned rearwardly of the seat, and the seat is disposed at a second seat angle relative to the underlying surface that is less than the first seat angle, the rear portion of the seat having risen in moving from the upright to the fully reclined position;

further comprising a handle rotatably mounted to one of the frame arms and connected with the ottoman linkage to drive the ottoman linkage between the retracted and extended positions;

wherein the reclining mechanism further comprises a movement-resistance unit that resists movement of the backrest from the upright to the fully reclined position; and wherein the movement-resistance unit is configured to allow the backrest to cease movement in any position between the upright and fully reclined positions.

16. The reclining seating unit defined in claim 15, wherein the movement-resistance unit comprises a gas cylinder.

17. The reclining seating unit defined in claim 16, wherein the reclining mechanism includes a control linkage comprising:

a cylinder pivot unit pivotally attached to one end of the gas cylinder and pivotally interconnected relative to the frame;

a finger pivotally attached to an opposite end of the gas cylinder and pivotally interconnected relative to the frame; and a backrest drive link pivotally attached to the cylinder pivot unit and with a backpost fixed to the backrest.

18. The reclining seating unit defined in claim 17, wherein the backrest drive link is coupled to a control linkage that includes said gas cylinder.

19. The reclining seating unit defined in claim 17, wherein the backpost, cylinder pivot unit and ottoman linkage are pivotally attached to a unitary mounting bracket.

20. The reclining seating unit defined in claim 15, wherein the frame further comprises castors.

* * * * *